US012246892B2

(12) United States Patent
Sabherwal

(10) Patent No.: US 12,246,892 B2
(45) Date of Patent: Mar. 11, 2025

(54) LOCKABLE CLOSURE

(71) Applicant: HALEON US HOLDINGS LLC, Wilmington, DE (US)

(72) Inventor: Amit Sabherwal, Warren, NJ (US)

(73) Assignee: HALEON US HOLDINGS LLC, Wilmington, DE (US)

( * ) Notice: Subject to any disclaimer, the term of this patent is extended or adjusted under 35 U.S.C. 154(b) by 0 days.

(21) Appl. No.: 16/327,471

(22) PCT Filed: Aug. 24, 2017

(86) PCT No.: PCT/US2017/048336
§ 371 (c)(1),
(2) Date: Feb. 22, 2019

(87) PCT Pub. No.: WO2018/039413
PCT Pub. Date: Mar. 1, 2018

(65) Prior Publication Data
US 2019/0177051 A1 Jun. 13, 2019

(30) Foreign Application Priority Data
Aug. 24, 2016 (IN) ..... 201611028842

(51) Int. Cl.

| | |
|---|---|
| ***B65D 50/04*** | (2006.01) |
| ***B65D 41/00*** | (2006.01) |
| ***B65D 41/04*** | (2006.01) |
| ***B65D 41/10*** | (2006.01) |
| ***B65D 41/16*** | (2006.01) |
| ***B65D 41/18*** | (2006.01) |
| ***B65D 41/30*** | (2006.01) |
| ***B65D 41/32*** | (2006.01) |

(Continued)

(52) U.S. Cl.
CPC ..... *B65D 50/045* (2013.01); *B65D 41/00* (2013.01); *B65D 41/04* (2013.01); *B65D 41/10* (2013.01); *B65D 41/16* (2013.01); *B65D 41/18* (2013.01); *B65D 41/30* (2013.01); *B65D 41/325* (2013.01); *B65D 41/3423* (2013.01); *B65D 41/60* (2013.01); *B65D 47/0809* (2013.01); *B65D 50/06* (2013.01); *B65D 2215/04* (2013.01); *B65D 2251/023* (2013.01); *B65D 2251/1058* (2013.01); *B65D 2401/25* (2020.05)

(58) Field of Classification Search
CPC ..... B65D 50/045; B65D 47/0804
See application file for complete search history.

(56) References Cited

U.S. PATENT DOCUMENTS

| | | | |
|---|---|---|---|
| 3,295,726 | A | 1/1967 | Hanson |
| 4,790,442 | A | 12/1988 | Gach |

(Continued)

FOREIGN PATENT DOCUMENTS

| | | |
|---|---|---|
| CN | 1676435 | 10/2005 |
| CN | 201296420 | 8/2009 |

(Continued)

*Primary Examiner* — Jeffrey R Allen
(74) *Attorney, Agent, or Firm* — E. Eric Mills; Nicholas P. Stadnyk; Maynard Nexsen PC

(57) ABSTRACT

Aspects of the present invention are directed to a child-proof cap that is easier to open for adults than traditional child-resistant closures, yet remains resistant to opening by children. The child-proof cap may be opened in a pull-and-flip motion with a single hand.

16 Claims, 9 Drawing Sheets

(51) Int. Cl.

| | |
|---|---|
| ***B65D 41/34*** | (2006.01) |
| ***B65D 41/60*** | (2006.01) |
| ***B65D 47/08*** | (2006.01) |
| ***B65D 50/06*** | (2006.01) |

(56) References Cited

U.S. PATENT DOCUMENTS

| | | | | |
|---|---|---|---|---|
| 4,852,770 | A * | 8/1989 | Sledge | B65D 50/045 222/546 |
| 5,427,260 | A | 6/1995 | Mueller et al. | |
| 5,577,626 | A * | 11/1996 | Henkel | B65D 47/0804 215/237 |
| 2005/0218105 | A1 | 10/2005 | Arai | 215/237 |
| 2016/0009463 | A1 | 1/2016 | Stull, Sr. | |
| 2017/0001764 | A1 * | 1/2017 | Belleville | B65D 43/162 |

FOREIGN PATENT DOCUMENTS

| | | |
|---|---|---|
| CN | 203461284 | 3/2014 |
| JP | 2012096808 | 5/2012 |

* cited by examiner

LOCKABLE CLOSURE

This application is a 371 of International Application No. PCT/US2017/048336, filed 24 Aug. 2017, which claims the priority of India Provisional Application No. 201611028842, filed 24 Aug. 2016, which is incorporated herein in its entirety.

TECHNOLOGY FIELD

Aspects of the present invention are directed to a child-resistant closure and, in particular, a child-resistant closure that is more easily manipulated by adults with manual dexterity issues.

BACKGROUND

Child-resistant closures designed to prevent children from ingesting potentially dangerous substances are a priority to companies selling products that may be dangerous to children if ingested without adult supervision. This is particularly true for pharmaceutical and consumer healthcare companies. Current statistics show that almost a third of reported pediatric exposures to toxic substances were due to inadvertent drug ingestion. Further, over seventy percent of resulting pediatric fatalities are due to unintended exposure to dangerous substances.

Thus, child-resistant packaging has been an area of significant research over the past several decades. Known child-resistant closures include apparatuses that require the user to: line up indicators on the cap with the bottle, push down the cap while turning, squeeze the sides of the cap, squeeze the tabs and then turn the cap, or push the tab while lifting the lid. These types of closures meet the standard of being child-resistive, and they are effective at reducing the risk of inadvertent pediatric drug exposure. However, child-resistant closures can be problematic for adults with manual dexterity issues.

Consumers with arthritis and people with disabilities have a higher per capita rate of consumption of both OTC and prescription drugs. Opening medicine bottles with child-resistant closures may cause painful strain on the intercarpal joints of users with arthritis and similar conditions. Difficulty opening child-resistant closures has been given as a reason for deviating from prescribed drug dosing regimens. Consequently, a child-resistant closure member that is easily manipulated by adults with manual dexterity issues would be highly desirable.

SUMMARY

Aspects of the present invention are directed to a child-proof closure comprising: a lid and a lid base. The lid base may have an inner annular wall defining an opening, a base skirt extending around at least a portion of the inner annular wall, and a moveable locking member having a bottom portion affixed to the lid base and a top portion with a lip extending above the annular wall for securing the lid to the lid base. The lid is in a closed position when the lid and lid base are mated and the moveable locking member lip is engaged with and above at least a portion of the lid. The top portion of the moveable locking member is displaceable outwardly away from the lid to disengage the lip from the lid thereby allowing the lid to be opened.

The lid further may further comprise an inner lid wall and a lid skirt extending around at least a portion of the inner lid wall. The lid skirt may be mateable to the base skirt when the lid and lid base are in the closed position. In some embodiments, the lid and lid base are connected by a hinge. The inner lid wall may fit within the inner annular wall when the closure is in the closed position. In some embodiments, the inner annular wall and the inner lid wall form a seal. The seal may be a resealable seal. The seal may also me moisture-tight seal.

In certain embodiments, the lid base may be connected to a container. The lid base may be integrally connected to a container. In some embodiments, the cap of the present invention may further comprise a tamper-evident tab.

Additional aspects of the present invention may comprise a child-proof container system comprising lid and a container. The container may have a distal end and a proximal end having an inner annular wall defining an opening, a base skirt extending around at least a portion of the inner annular wall, and a moveable locking member having a bottom portion affixed to the base skirt and a top portion with a lip extending above the annular wall for securing the lid to the container. The lid may be in a closed position when the lid and container are mated and the moveable locking member lip is engaged with and above at least a portion of the lid. The top portion of the moveable locking member is displaceable outwardly away from the lid to disengage the lip from the lid thereby allowing the lid to be opened. The lid may further comprise an inner lid wall and a lid skirt extending around at least a portion of the inner lid wall. The lid skirt may be mateable to the base skirt when the lid and container are in the closed position. In certain embodiments, the lid and container are connected by a hinge. In some embodiments, the inner lid wall fits within the inner annular wall when the closure is in the closed position and may form a seal. The seal may be resealable. The seal may be moisture-tight. Systems of the present invention may further comprise a tamper evident tab.

DETAILED DESCRIPTION

Figure 1:
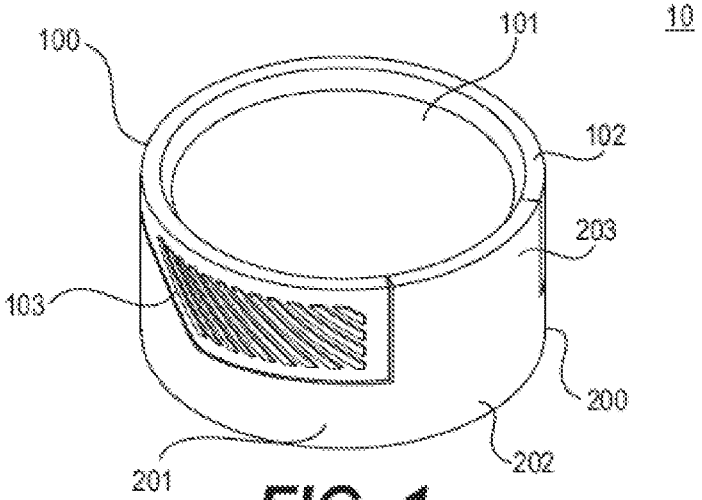
FIG. 1 is a top perspective view of an embodiment of the present invention in the closed position.

Aspects of the present invention are directed to a child-proof cap that is easier to open for adults than traditional child-resistant closures, yet remains resistant to opening by children. The child-proof cap may be opened in a pull-and-flip motion with a single hand. The cap may comprise a lid and a lid base. The lid base may have an inner annular wall defining an opening and a base skirt extending around at least a portion of the inner annular wall, and a flexible locking member. The flexible locking member may have a bottom portion affixed to the lid base and a top portion with a lip extending above the inner annular wall for securing the lid to the lid base. When the lid is in a closed position the lid and lid base may be mated and the flexible locking member lip is engaged with and above at least a portion of the lid. To open the lid, the top portion of the flexible locking member is displaced outwardly away from the lid to disengage the flexible locking member lip from the lid, thereby allowing the lid to be opened.

Caps of the present invention may be suitable for opening with a single hand in a "pull-and-flip" motion. A user can pull on the moveable locking member with their thumb to disengage the flexible locking member lip from the lid and then push up or flip the lid with their thumb in a single motion.

Child-proof caps of the present invention may be connected to a container either integrally or non-integrally. If the cap is integrally connected to the container, the cap and the container may be formed of a blow-molded material or injection molded using methods know to one skilled in the art. Those non-integrally connected may be connected, for example, by screw on with external or internal thread or snap fit with annular ring. Preferably, the cap is permanently fixed to the interior wall of the container body after or before the container is filled, thereby rendering the container body and cap into a connected system. The cap may be permanently fixed to the container body by any suitable manner known in the art. For example, the cap and the container body may be sized so as to provide a friction fit for the cap. Alternatively the cap may be permanently attached via a mechanical snap. Although it is preferable to permanently fix the cap to the container body after the container is filled with product, it will be appreciated by those of skill in the art that such permanent fixture may not be necessary.

Additionally, the lid base may be integrally formed with the container and the lid is attached non-integrally, such as, for example, with a strap or a removable hinge. In other embodiments, the lid not be attached to the container.

Caps of the present invention in combination with containers are suitable for storage of components that are dangerous to children if consumed without adult supervision. Exemplary contents include, for example, pharmaceutical medicines, consumer healthcare products, toxic material, caustic materials, among others.

Caps and containers of the present invention may typically be made of a polymer material that provides adequate protection for the product packaged in the container. The container and cap may be made from the same or different polymer material. Depending on the requirements of the pharmaceutical product, barrier materials such as polyvinyl chloride, polyethylene vinyl acetate, polyethylene, polypropylene, and poly vinylidene chloride may be used. In another embodiment, non-barrier materials may also be used. Non-barrier thermoplastic materials include polystyrene, polycarbonate, polyester terephthalate, polybutylene, metallocene catalyzed polyolefins and poly maleic anhydride. In a particular embodiment, the material may be high-density polypropylene. In another embodiment, the material may be polyethylenevinylacetate.

In one embodiment, the container is moisture-tight and is resealable to maintain the moisture tight properties. As used herein, the term "resealable" means that the container can be opened/reopened and closed or reclosed a numerous amount of times (e.g. more than 5 times) and still retain its moisture-tight properties. As used herein, the term "moisture tight" means the moisture ingress of the container is less than about 1500 micrograms of water/day, determined by the following test method: (a) place approximately one gram of molecular sieve in the container and record the weight; (b) close the resealable mechanism; (c) place the sealed container in an environmental chamber at conditions of 80% relative humidity and 72° F.; (d) after one day, weigh the container containing the molecular sieve; (e) after approximately two weeks, weigh the container; and (f) subtract the first day sample from the value obtained and divide by the number of days to calculate the moisture ingress of the container in units of micrograms of water/day.

In another embodiment, the container includes a desiccant. The desiccant may be entrained within the polymer material making up the container, or the desiccant may be coated along the interior surface of the container, or the desiccant may be included in a compartment either inside the container or on the interior portion of the cap.

Containers of the present invention may be of varied shapes and sizes.

FIGS. 1 to 9 show various views of a child-resistant cap of the present invention. FIG. 1. shows an exemplary child-resistant cap in closed position. Cap 10 includes lid 100 and lid base 200. Lid 100 includes top 101, top rim 102, lid skirt 103, and inner lid wall 104. Top 100 is circular and is surrounded by top rim 102. Lid skirt 103 extends downward from top rim 102. Lid base 200 includes base skirt 201 and moveable locking member 202. Moveable locking member 202 is seamlessly connected to base skirt 201. Moveable locking member 202 extends upward to moveable member top 203. Moveable locking member top 203 includes lip 204. In the closed position, lid skirt 103 and base skirt 201 are mateable and lip 204 overlays a portion of top 101 to secure lid 100 to base 200.

Figure 2:
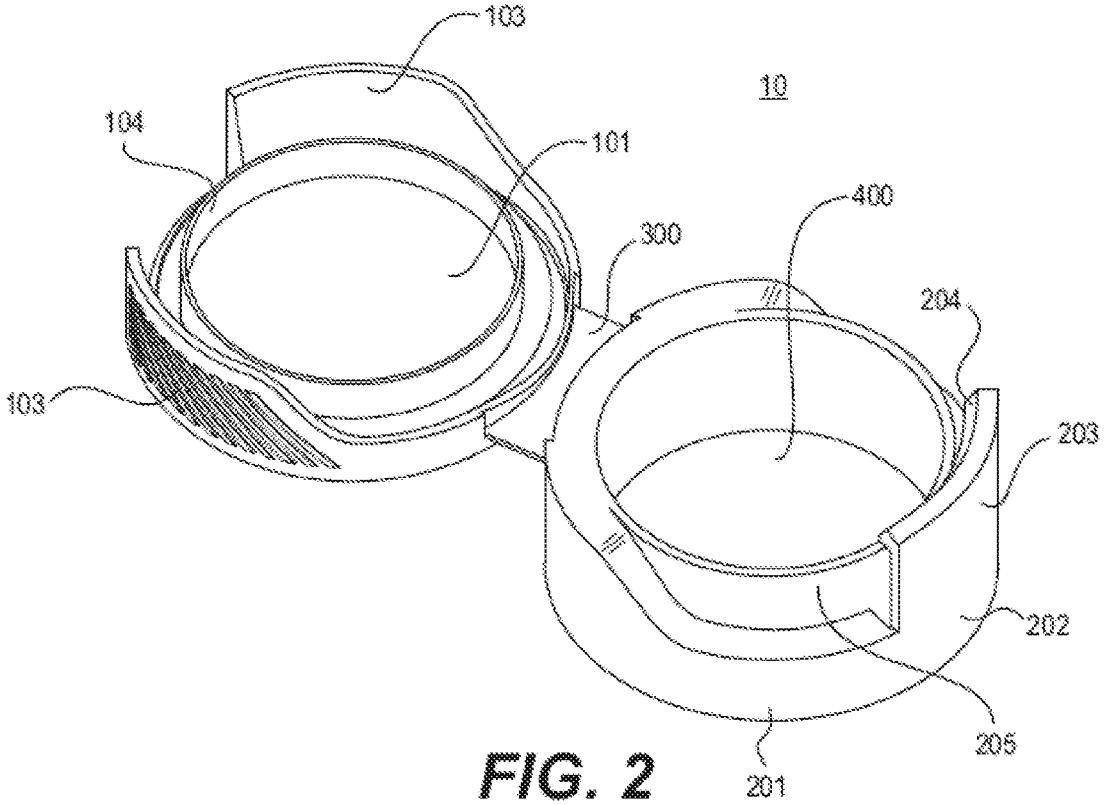
FIG. 2 is a top perspective view of an embodiment of the present invention in the opened position.
Figure 3:
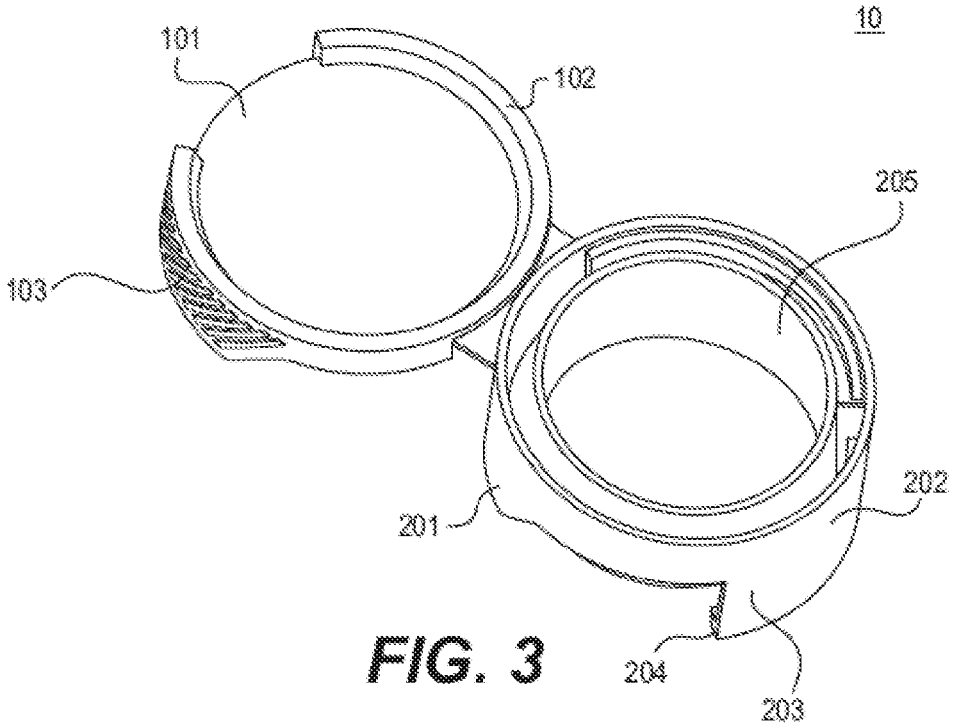
FIG. 3 is a bottom perspective view of an embodiment of the present invention in the opened position.
Figure 4:
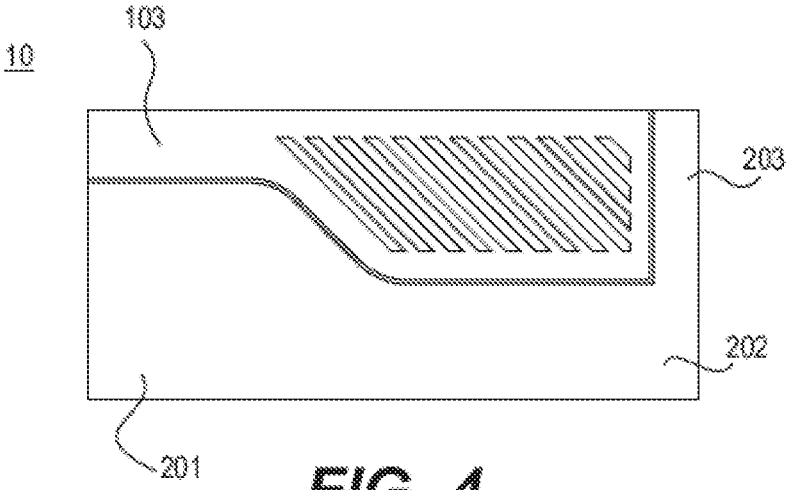
FIG. 4 is a side view of an embodiment of the present invention in the closed position.
Figure 5:
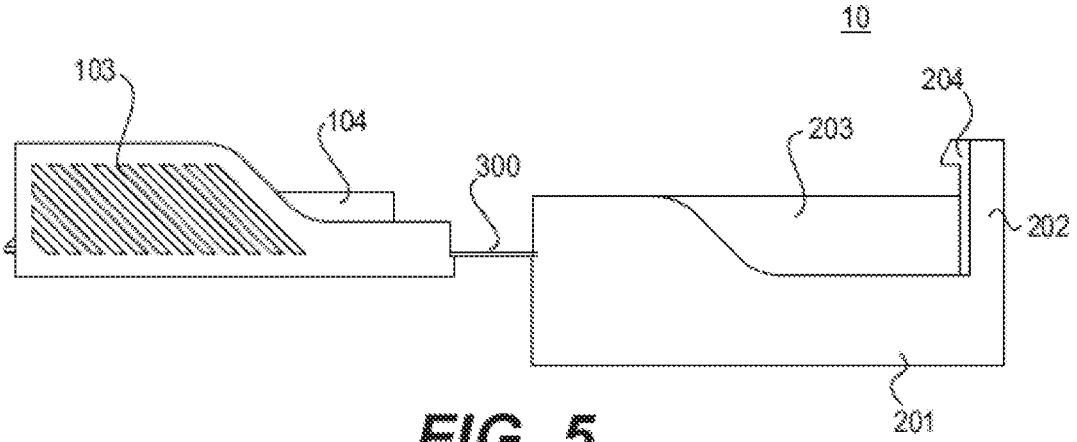
FIG. 5 is a side view of an embodiment of the present invention in the opened position.
Figure 6:
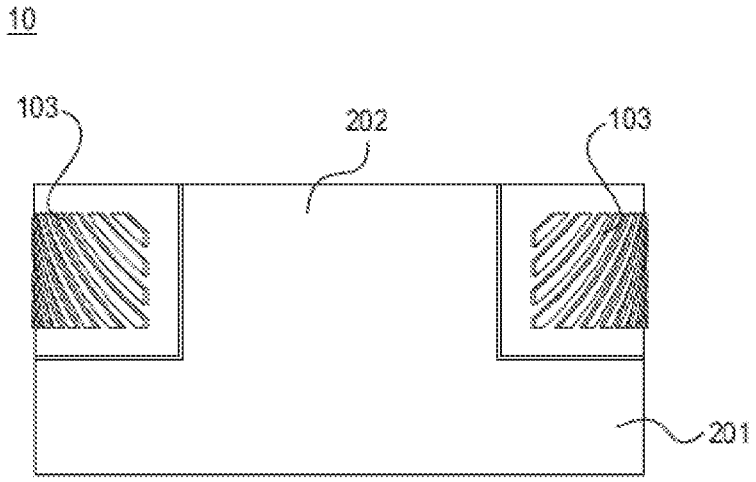
FIG. 6 is a front view of an embodiment of the present invention in the closed position.
Figure 7:
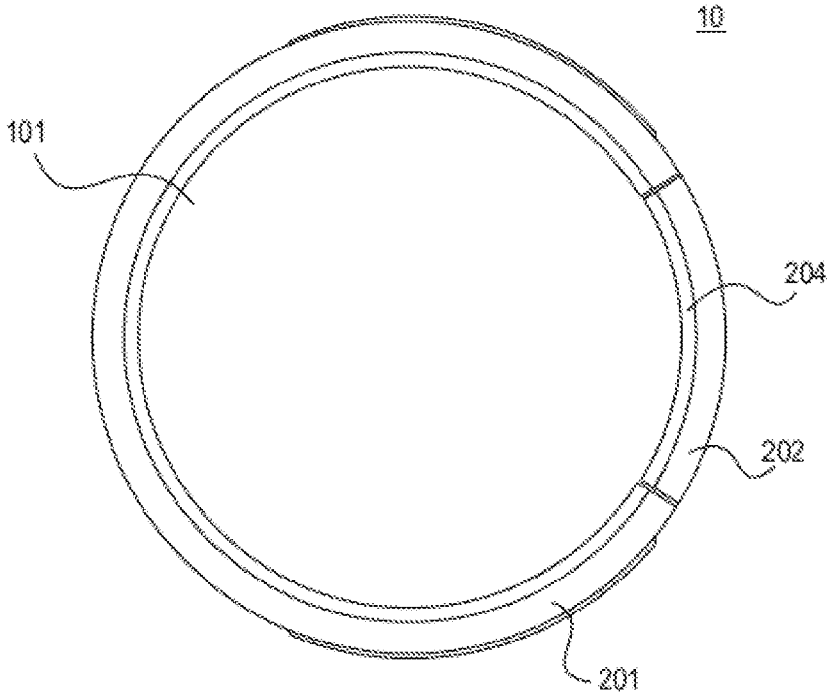
FIG. 7 is a top view of an embodiment of the present invention in the closed position.

FIG. 2 shows closure 10 in opened position. Lid 100 includes inner lid wall 104, attached to lid top 101 and is circular and interior to lid skirt 103. Lid base 200 further includes inner annular wall 205 interior to lid base skirt 201 and defines opening 400. Lid 100 and lid base 200 are connected by hinge 300.

Figure 8:
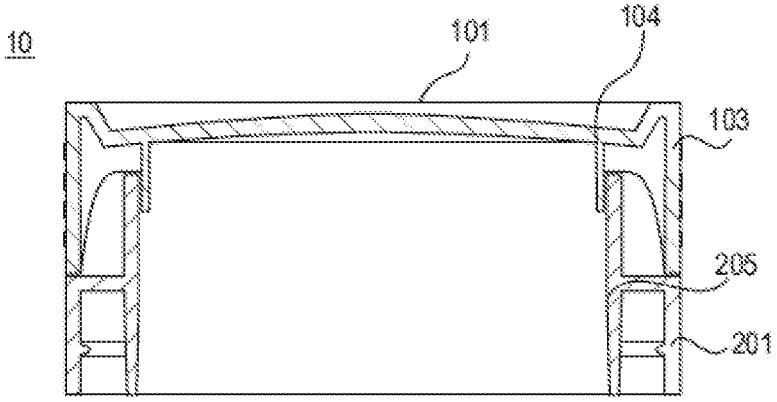
FIG. 8 is a cross sectional front view of an embodiment of the present invention in the closed position.
Figure 9:
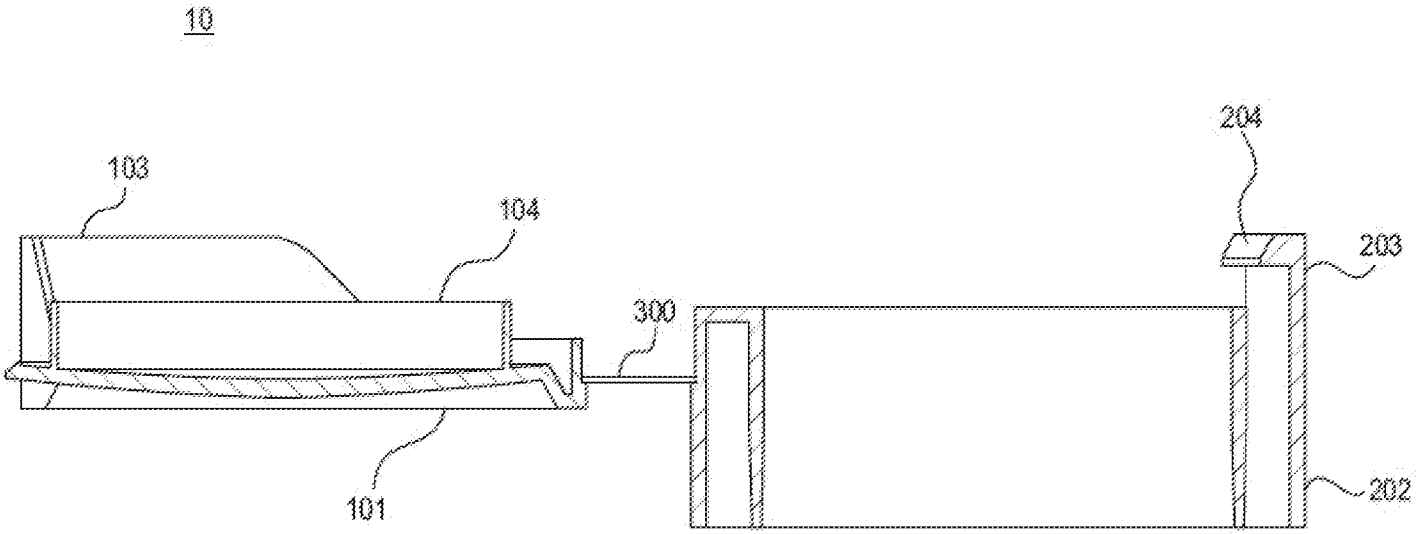
FIG. 9 is a cross sectional side view of an embodiment of the present invention in the opened position.

FIG. 8 shows a cross section view of the closure 10 in closed position. In the closed position, inner lid wall 104 is positioned interior to inner annular wall 205 of base 200. In closed position, lid skirt 103 and base skirt 201 are mateable.

Figure 11:
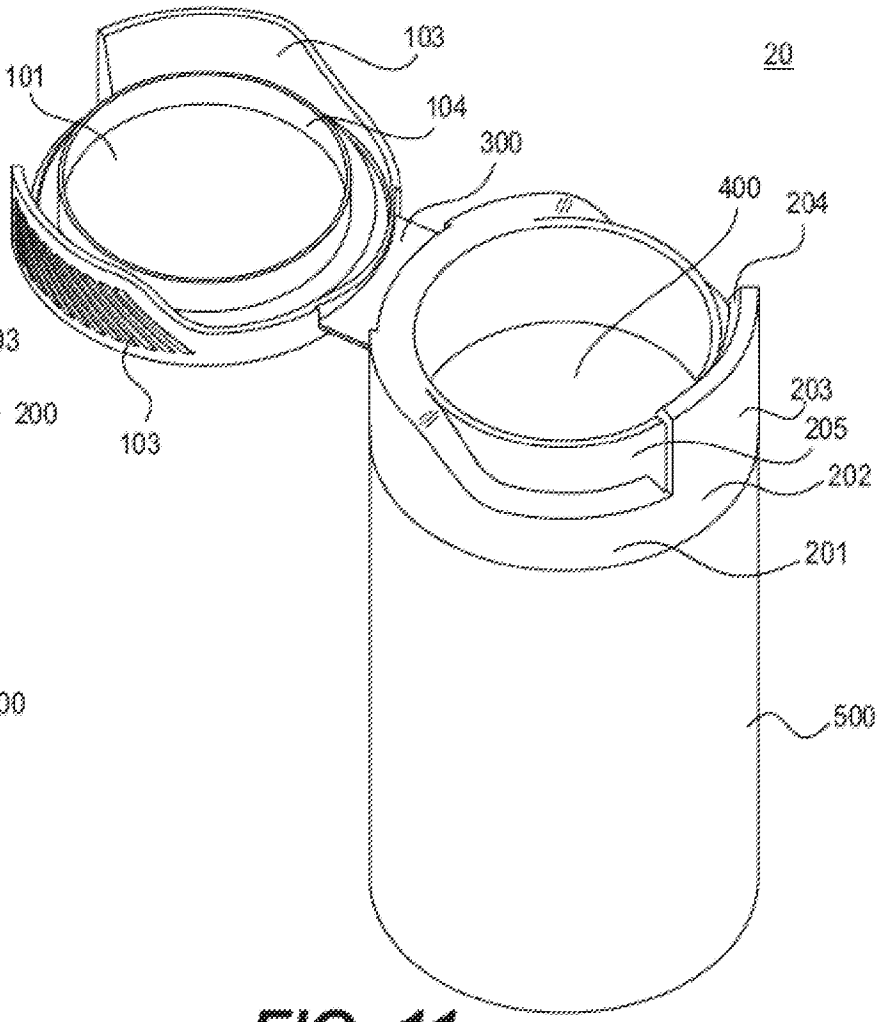
FIG. 11 is a top perspective view of an alternative embodiment of the present invention in the opened position.
Figure 10:
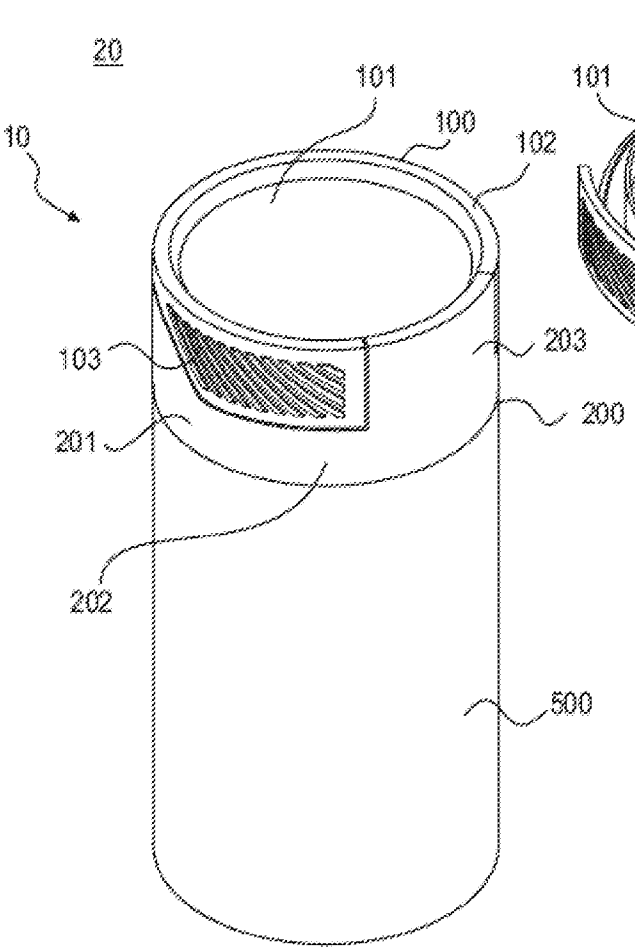
FIG. 10 is a top perspective view of an alternative embodiment of the present invention in the closed position.

FIGS. 10-13 show various views of container systems of the present invention. FIGS. 10 and 11 show container system 20 with cap 10 in combination with container 500. In this embodiment, closure 10 and container 500 are non-intergrally connected.

Figure 13:
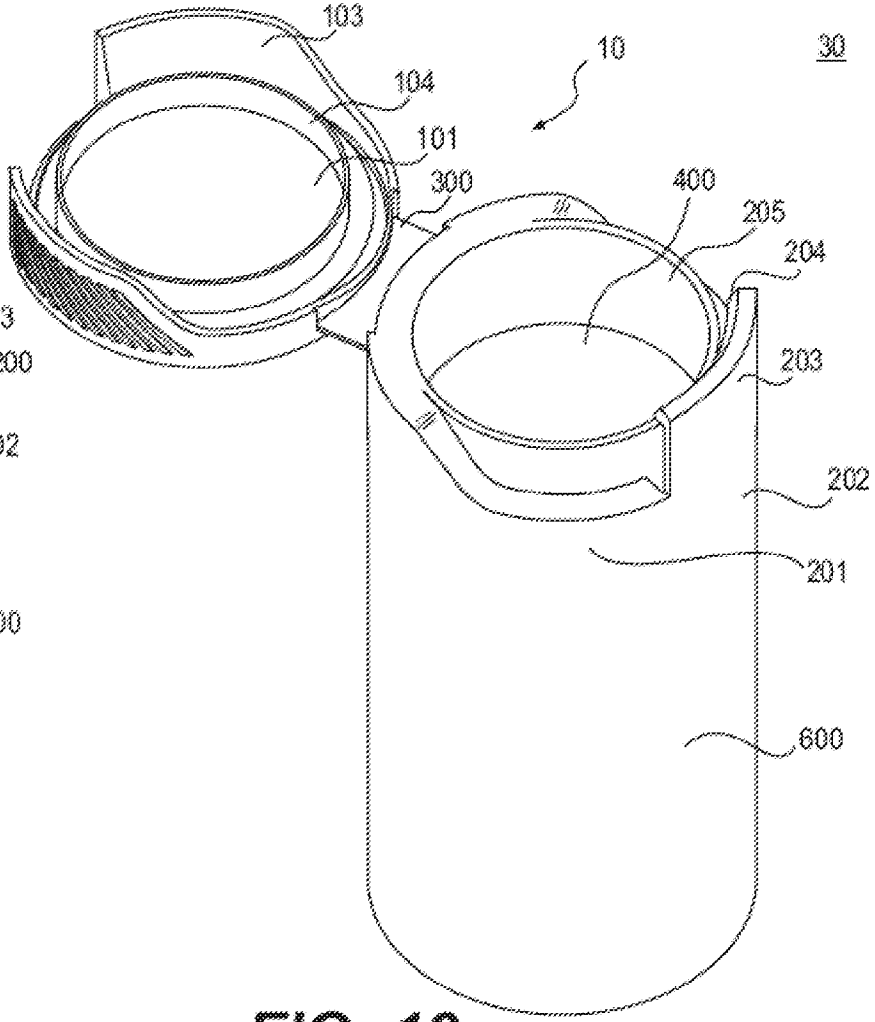
FIG. 13 is a top perspective view of an alternative embodiment of the present invention in the opened position.
Figure 12:
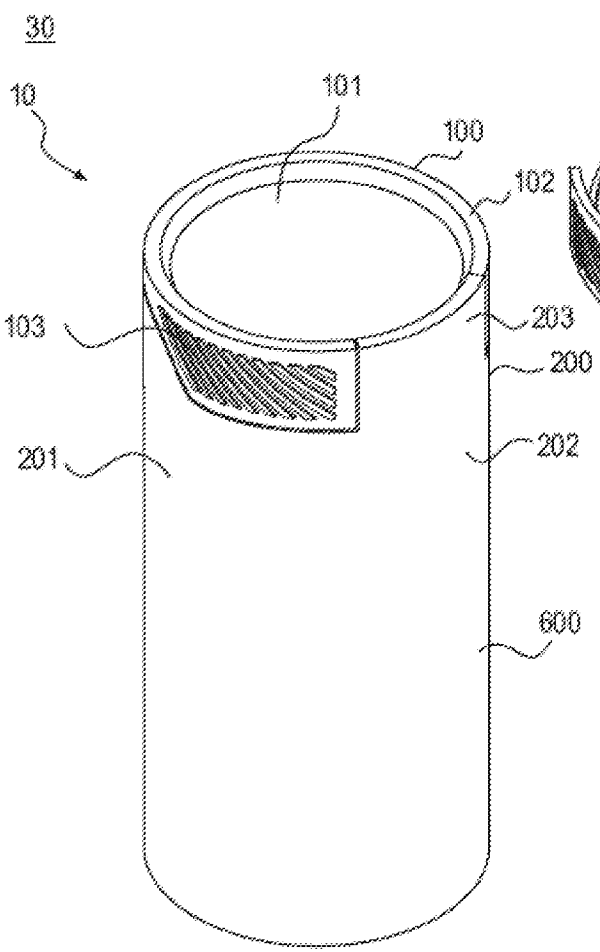
FIG. 12 is a top perspective view of an alternative embodiment of the present invention in the closed position.

FIGS. 12 and 13 show container system 30 with closure 10 in combination with container 600. In this embodiment, cap 10 is integrally connected to container 600.

Figure 14:
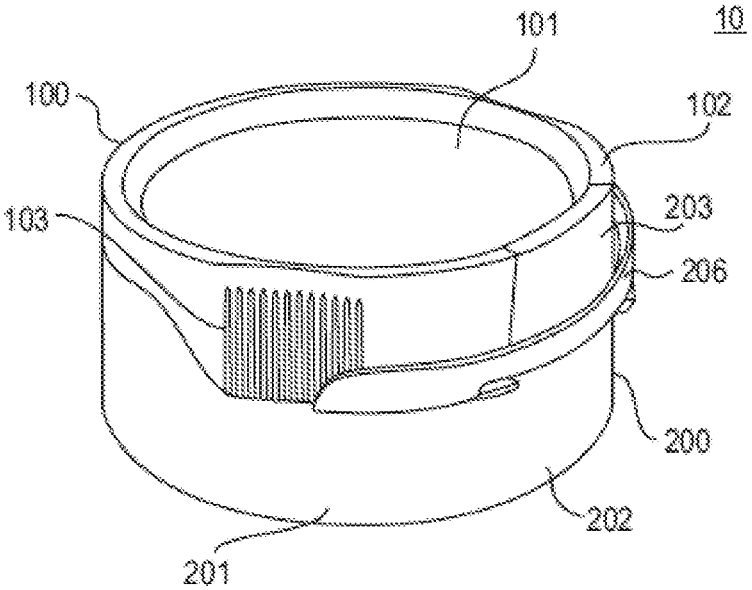
FIG. 14 is a top perspective view of an embodiment of the present invention in the closed position.
Figure 15:
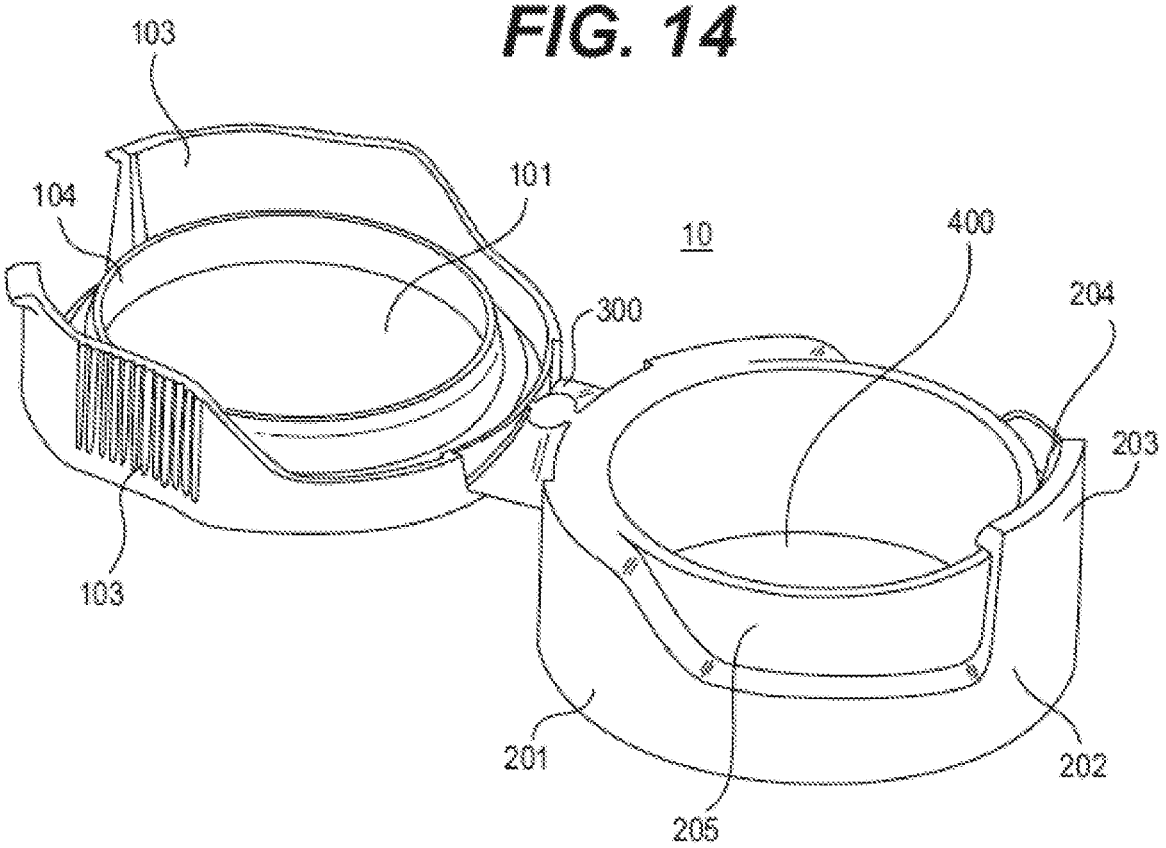
FIG. 15 is a top perspective view of an embodiment of the present invention in the opened position.

FIGS. 14 and 15 shows an alternative enclosure embodiment having tamper evident tab 206 attached to base skirt 201. To open top 101, tamper evident tab 206 must be removed from base skirt 201. After removal of tamper evident tab 206, moveable locking member 202 can be displaced outwardly away from top 101 to disengage moveable locking member top 203 from top 101 and subsequently moving top 101 in an upward direction to open container.

Figure 16A:
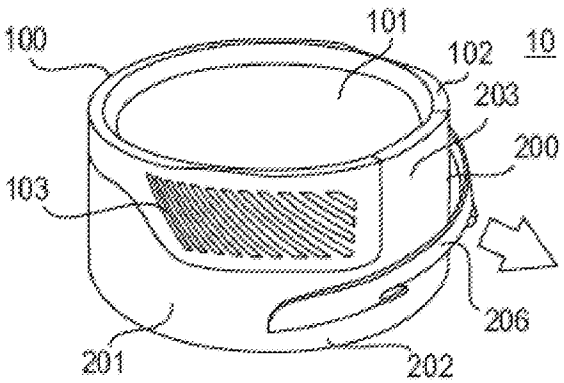
FIG. 16 is a schematic of a method of using an embodiment of the present invention.
Figure 16B:
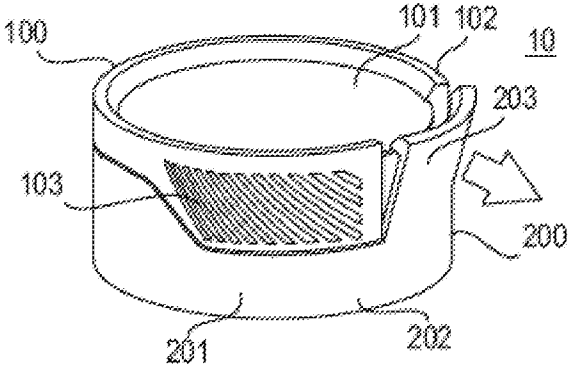
Figure 16D:
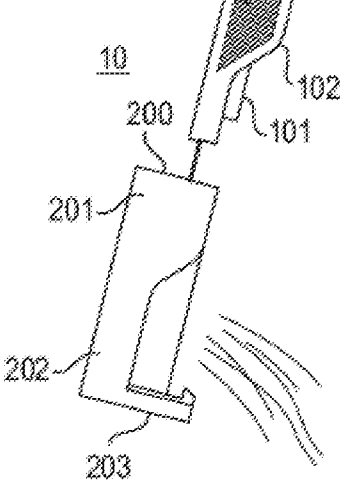
Figure 16E:
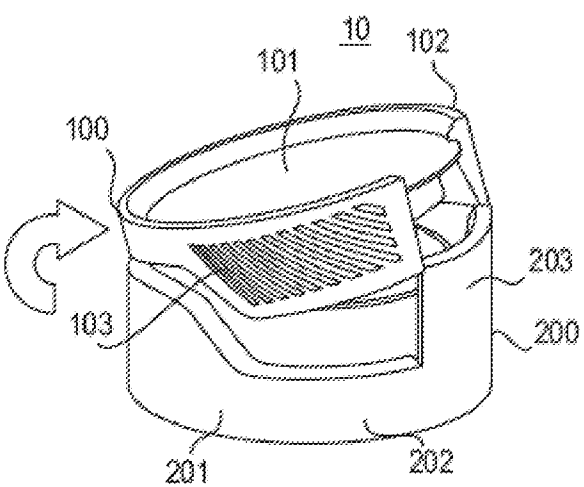
Figure 16C:
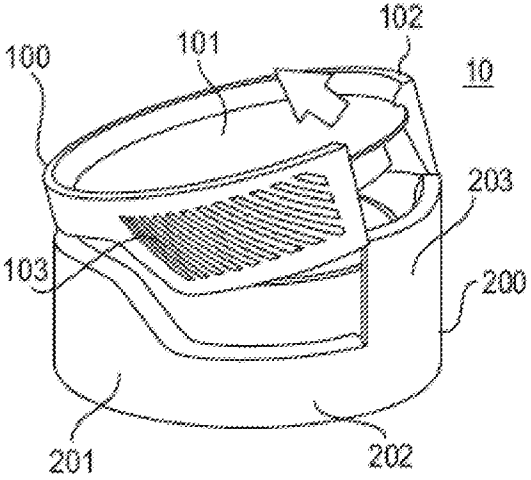

FIG. 16A to FIG. 16E shows a method of opening, dispensing from, and closing a cap of the present invention. Tamper evident tab 206 is removed from cap 10 (FIG. 16A), moveable locking member 202 is moved so that moveable locking member top 203 is moved away from the top 101 and so that lip 204 is disengaged from top 101 (FIG. 16B). Top 101 is then moved in an upward direction about hinge 300 to allow access to opening 400 (FIG. 16C). Material can then be dispensed from opening (FIG. 16D) and cap 10 can then be reclosed (FIG. 16E).

What is claimed is:

1. A child-proof cap comprising:

a lid having a circular top surrounded by a top rim, an inner lid wall, a lid skirt extending downward from the top rim and extending around at least a portion of the inner lid wall; and a lid base having an inner annular wall defining an opening, a base skirt extending around at least a portion of the inner annular wall, and a moveable locking member having a bottom portion affixed to the lid base and a top portion with a lip extending above the annular wall for securing the lid to the lid base, and wherein the moveable locking member is seamlessly connected to the base skirt;

wherein the inner lid wall fits within the inner annular wall and the lid skirt is mateable to the base skirt when the lid and lid base are in a closed position and the moveable locking member lip extends above the inner wall and is engaged with and overlaps at least a portion of a front edge of a topmost surface of the circular top of the lid securing and physically holding the lid to the lid base in the closed position; and the top portion of the moveable locking member being displaceable outwardly away from the circular top of the lid to disengage the lip from the lid thereby allowing the lid to be opened in a pull and flip motion with a single hand.

2. The cap of claim 1, wherein the lid and lid base are connected by a hinge.

3. The cap of claim 1, wherein the inner annular wall and the inner lid wall form a seal.

4. The cap of claim 1, wherein the inner annular wall and the inner lid wall form a resealable seal.

5. The cap of claim 1, wherein the inner annular wall and the inner lid wall form a moisture-tight seal.

6. The cap of claim 1, wherein the lid base is connected to a container.

7. The cap of claim 3, wherein the lid base is integrally connected to a container.

8. The cap of claim 1, further comprising a tamper-evident tab.

9. A child-proof container system comprising:

a lid having a circular top surrounded by a top rim, an inner lid wall, a lid skirt extending downward from the top rim and extending around at least a portion of the inner lid wall; and a container having a distal end and a proximal end having an inner annular wall defining an opening, a base skirt extending around at least a portion of the inner annular wall, and a moveable locking member having a bottom portion affixed to the base skirt and a top portion with a lip extending above the annular wall for securing the lid to the container, wherein the moveable locking member is seamlessly connected to the base skirt;

wherein the lid is in a closed position when the lid and container are mated, the lid skirt is mateable to the base skirt and the inner lid wall fits within the inner annular wall when the lid and container are in the closed position and the moveable locking member lip extends above the inner annular wall and is engaged with and overlaps at least a portion of a front edge of a topmost surface of the circular top of the lid securing and physically holding the lid to the lid base in the closed position; and the top portion of the moveable locking member being displaceable outwardly away from the lid to disengage the lip from the lid thereby allowing the lid to be opened in a pull and flip motion with a single hand.

10. The system of claim 9, wherein the lid and container are connected by a hinge.

11. The system of claim 1, wherein the inner annular wall and the inner lid wall form a seal.

12. The system of claim 1, wherein the inner annular wall and the inner lid wall form a resealable seal.

13. The system of claim 1, wherein the inner annular wall and the inner lid wall form a moisture-tight seal.

14. The system of claim 9, further comprising a tamper evident tab.

15. The cap of claim 1, wherein the moveable locking member lip is engaged with and above at least a portion of a top surface of the lid.

16. The system of claim 9, wherein the moveable locking member lip is engaged with and above at least a portion of a top surface of the lid.

* * * * *